US006254265B1

(12) United States Patent
MacDonald

(10) Patent No.: US 6,254,265 B1
(45) Date of Patent: Jul. 3, 2001

(54) METHOD AND APPARATUS FOR MIXING MATERIALS

(76) Inventor: Rodney N. MacDonald, P.O. Box 567, Penngrove, CA (US) 94951

( * ) Notice: Subject to any disclaimer, the term of this patent is extended or adjusted under 35 U.S.C. 154(b) by 0 days.

(21) Appl. No.: 09/492,775

(22) Filed: Jan. 28, 2000

Related U.S. Application Data

(60) Provisional application No. 60/117,493, filed on Jan. 27, 1999.

(51) Int. Cl.[7] ..... B28C 5/00; B28C 5/44

(52) U.S. Cl. ..... 366/1; 366/129; 383/4

(58) Field of Search ..... 383/4, 6, 10, 25; 366/129, 3, 1, 4, 6, 53, 349, 348, 347

(56) References Cited

U.S. PATENT DOCUMENTS

| | | | | |
|---|---|---|---|---|
| Re. 34,849 | * | 2/1995 | Sanders | 383/4 |
| 219,080 | * | 9/1879 | Edwards | 383/4 |
| 732,838 | * | 7/1903 | Edwards | 383/4 |
| 1,001,114 | * | 12/1911 | Button | 383/4 |
| 1,538,022 | * | 5/1925 | Brekke | 383/4 |
| 1,871,101 | * | 8/1932 | Waltz | 383/4 |
| 1,986,743 | * | 1/1935 | Musick | 383/25 |
| 2,312,444 | * | 3/1943 | RochFord et al. | 366/349 |
| 2,922,553 | * | 1/1960 | Wilson, III | 383/4 |
| 4,470,703 | * | 9/1984 | Nickerson, Jr. | 366/3 |
| 4,500,129 | * | 2/1985 | Hahn | 383/4 |
| 4,682,447 | * | 7/1987 | Osborn | 383/4 |
| 4,938,607 | * | 7/1990 | Kelley | 383/4 |
| 5,083,825 | * | 1/1992 | Bystrom et al. | 383/13 |
| 5,417,462 | * | 5/1995 | Hensley | 383/4 |
| 5,577,730 | * | 11/1996 | Vannozzi, Sr. | 383/4 |
| 5,743,636 | * | 4/1998 | Payne | 366/129 |

* cited by examiner

*Primary Examiner*—Tony G. Soohoo
(74) *Attorney, Agent, or Firm*—Johnson & Stainbrook, LLP; Larry D. Johnson; Craig M. Stainbrook

(57) ABSTRACT

A method and apparatus for mixing materials comprising a unitary sheet of fiberreinforced plastic tarpaulin having reinforced stitching along the sides of the fabric and handles for grasping the tarp attached at the corners of the tarp, primarily intended for use in the preparation of small quantities of concrete in the residential setting, but adaptable for preparing and mixing of a variety of other materials, including mortar, soils, compost, and the like.

4 Claims, 3 Drawing Sheets

METHOD AND APPARATUS FOR MIXING MATERIALS

CROSS-REFERENCES TO RELATED APPLICATIONS

The present applications claims the benefit of the filing date of U.S. Provisional Application, Ser. No. 60/117,493, filed Jan. 27, 1999.

BACKGROUND OF THE INVENTION

1. Field of the Invention

The present invention relates generally to devices adapted for manually mixing materials and/or liquids into a composite material, including, for example, concrete or other construction materials. More specifically, the present invention relates to a sturdy lightweight tarp having reinforced edges and handles for mixing discrete materials into composite materials.

2. Description of Related Art

Tarpaulins have long been used for a variety of purposes: as covers to protect objects from the elements outdoors; as wind breaks and shelters; as ground covers and drop cloths; as hauling sleds; even as a hot weather water toys for children to slide on. It has been long known to reinforce a tarp at its edges by folding the edge and sewing it. Additionally, it is also known to provides grommets at various locations along the edges of a tarp and at its comers for connection to rope or other kinds of fine, or for securing to hooks or ground stakes. However, it is not known to provide and use a reinforced tarpaulin with corner handles for mixing materials.

SUMMARY OF THE INVENTION

The method and apparatus for mixing materials of this invention comprises a unitary sheet of fibre-reinforced plastic tarpaulin having reinforced stitching along the sides of the fabric and handles for grasping the tarp attached at the corners of the tarp. Its primary intended use is for the preparation of small quantities of concrete in the residential setting. However, it may be used for preparing and mixing of a variety of other materials, including mortar, soils, compost, and the like.

DETAILED DESCRIPTION OF A PREFERRED EMBODIMENT

Figure 1:
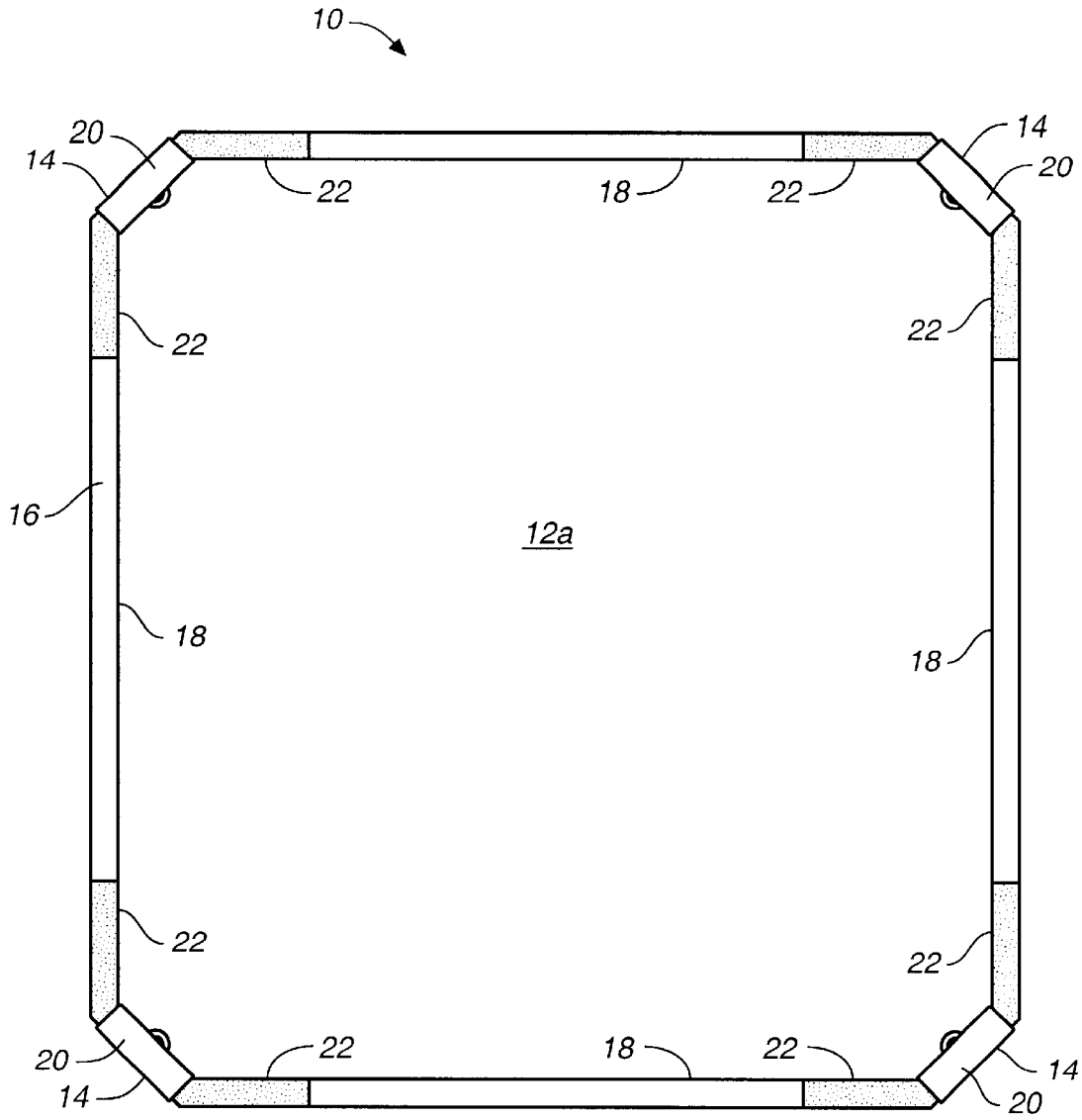
FIG. 1 is a top view of the mixing apparatus of the present invention.
Figure 2:
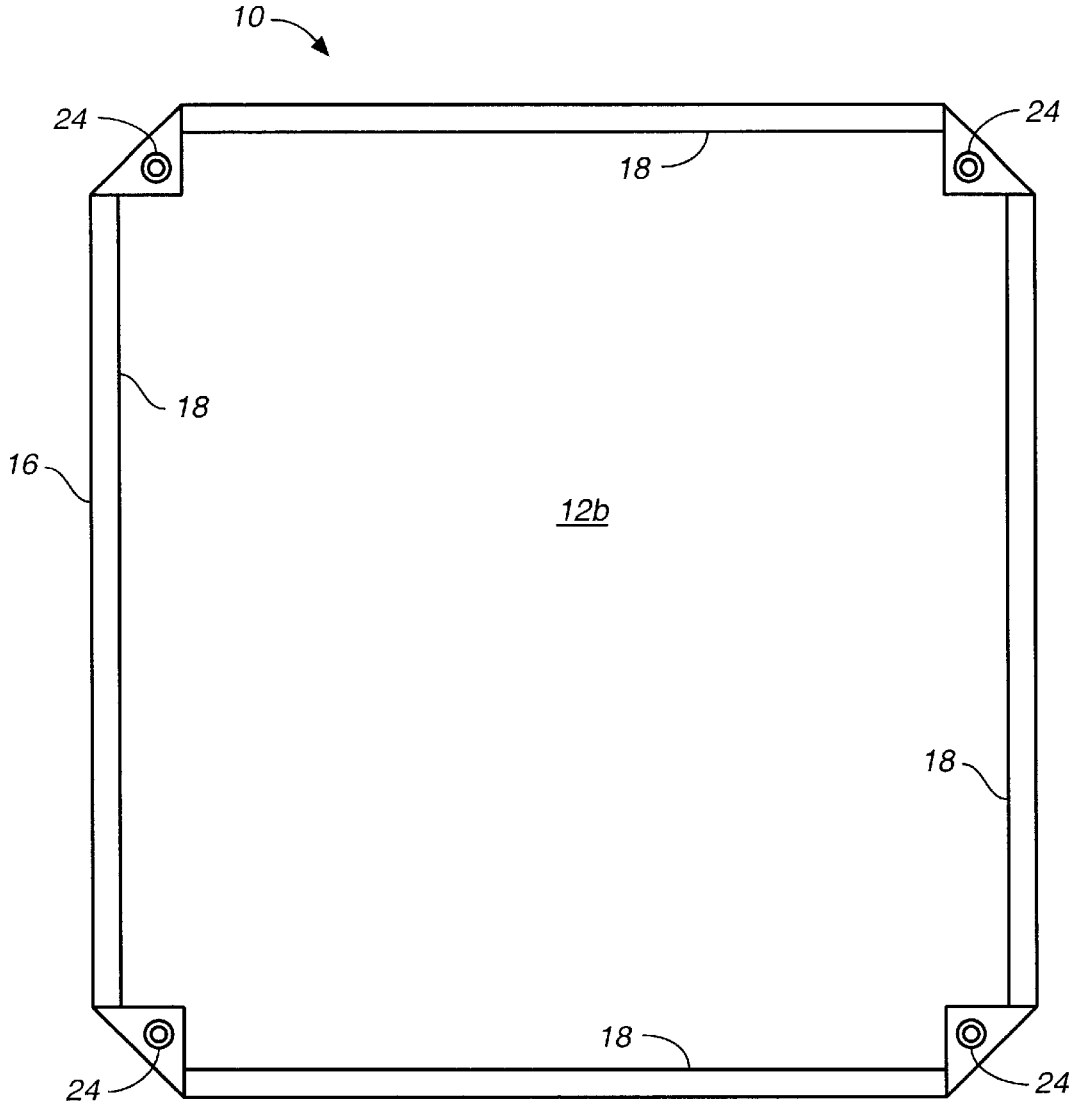
FIG. 2 is a bottom view of the apparatus of FIG. 1.

FIG. 1 is a top view and FIG. 2 is a bottom view of the apparatus for mixing materials of the present invention 10, showing that the apparatus comprises a unitary sheet of material 12 having a top surface 12*a* and a bottom surface 12*b*. Preferably the sheet is fabricated from fibre-reinforced thermoplastic material, and more preferably fibre-reinforced waterproof polyvinyl fabric sold under the trademark NOVAPRENE. However, the sheet may be fabricated from a multitude of well known materials and need only have sufficient flexibility, strength, and durability for mixing materials. If the materials to be mixed are dry, the material need not be waterproof or even water resistant. On the other hand, if the materials to be mixed include liquids, the material selected should include a substantially water-impermeable barrier. The sheet may comprise plural layers for added strength and durability, and the additional layers may be fabricated from the same material or different materials, depending upon the particular uses contemplated. Additionally, the sheet 12 may be any of a number of suitable shapes, though a balanced geometry provides the optimal balance when in use as a mixing apparatus. Accordingly, in the preferred embodiment, the sheet is substantially square with angled corners 14.

The apparatus further includes a reinforced edge or perimeter 16, produced by folding the edge of the material onto itself and stitching the fold with a sturdy hem 18. A handle 20 is located at each of the corners, preferably attached to the sheet by stitching integral flaps or tabs 22 at each end of said handles into or onto the hemmed perimeter 16. The handle is preferably made of canvas strap or thick fabric.

FIG. 2 shows that the corners may also include grommets 24 for securing the sheet for uses other than mixing materials. The grommets preferably provide holes through the sheet of a size sufficient for fastening a line or rope or for securing the sheet with a hook or ground stake.

Figure 3A:
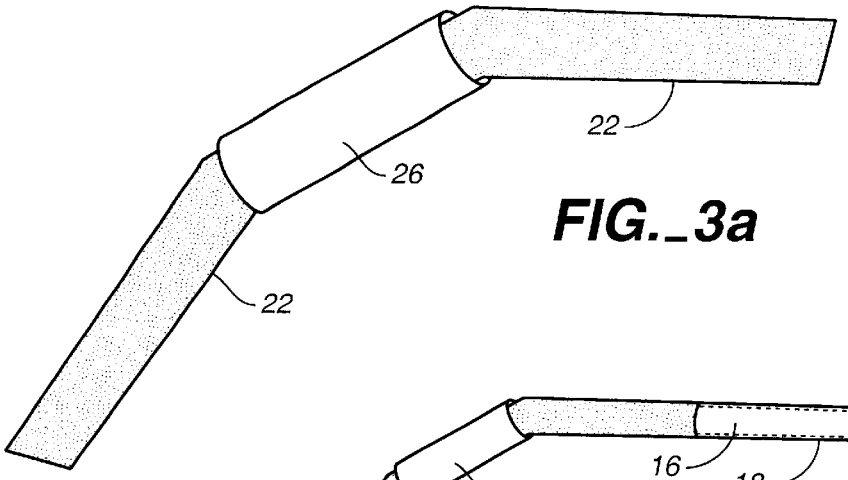
FIG. 3*a* is a perspective view showing details of the handle portion of the mixing apparatus.
Figure 3B:
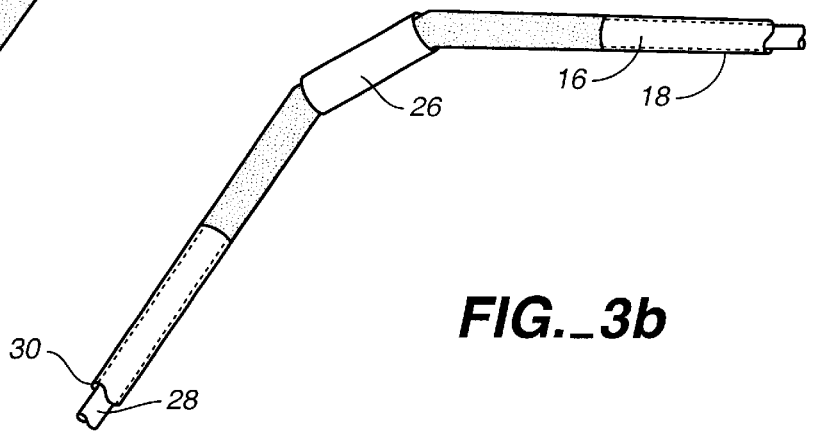
FIG. 3*b* shows the handle of FIG. 3*a* as installed in the corner of a tarp and includes a partial cutaway view showing a rope sewn into the perimeter of the apparatus.
Figure 3C:
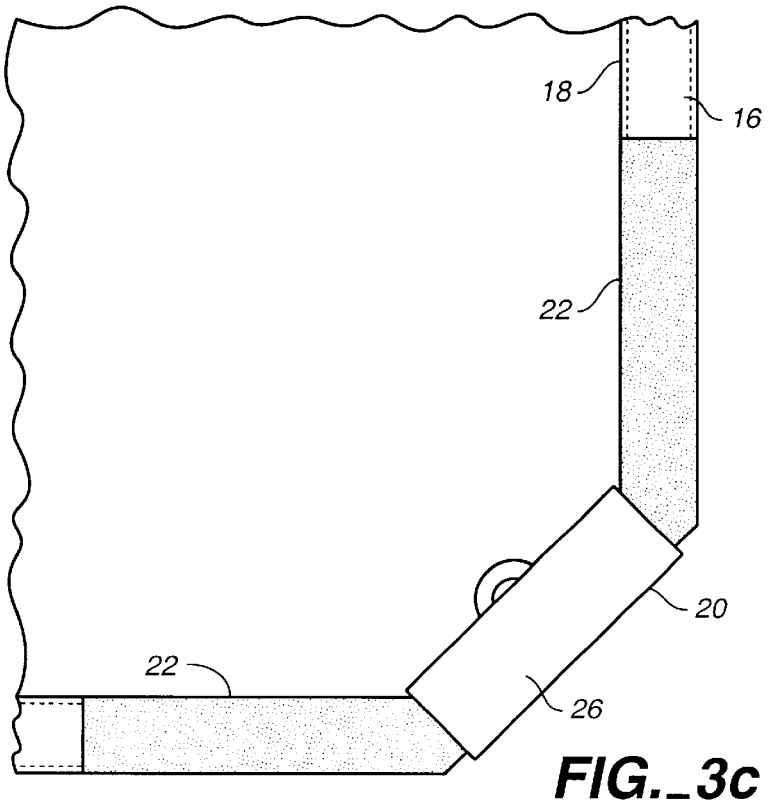
FIG. 3*c* is a top view of the handle portion shown in FIGS. 3*a* and 3*b*.

FIGS. 3*a* through 3*c* illustrate the handles in more detail. These drawings show that the handle 20 may include a cylindrical tube 26 that freely rotates around the length of fabric or other material which is directly affixed to the material sheet at the corner. The tube may be plastic, wood, metal or any other rigid material that provides a superior gripping and handling configuration under heavy loads. FIG. 3*b* further shows in a partial cutaway view that the reinforced perimeter 16 of the sheet may include a rope 28, preferably nylon, sewn into the sleeve 30 formed within the stitching line 18 at the edge of the sheet.

Dimensions of the mixing apparatus may be varied within limits imposed only by that which is practicable for manual manipulation.

To use the tarp for mixing materials, the user simply lays the tarp flat on the ground and places material to be mixed in the center area of the tarp. If liquids must be added, it may be expedient or necessary to prevent runoff by elevating the edges by grasping the handles at the corners and elevating them slightly. After all of the materials have been placed onto the tarp, the four handles are elevated so that only the center of the tarp is in contact with the ground. In an alternating sequence, the corners are individually raised and lowered in a rhythm and pace so as to induce an agitating action of the materials and so that the materials fold over one another. This is continued until the desired degree of mixing has been achieved. Once the material is mixed the tarp may be positioned and configured to funnel or pour the composite into the area where the material is needed.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An apparatus for mixing materials, said apparatus comprising:

a substantially square sheet of flexible fibre reinforced waterproof polyvinyl material having a top surface, a bottom surface, and a reinforced perimeter having edges folded back upon said sheet and stitched to form a hem, said perimeter having angled corners;

a handle located at each of said angled corners, said handle comprising a fabric strap having flaps at each one of two ends, said flaps sewn into said hemmed perimeter.

2. The apparatus of claim 1 having a plurality of grommets, including at least one located at each corner of said sheet.

3. The apparatus of claim 1 wherein said hemmed perimeter forms a sleeve in said hemmed perimeter.

4. The apparatus of claim 1 wherein said handle portion further includes a rigid cylindrical tube which rotates freely about said handle portion when in use.

* * * * *